US011168870B2

(12) United States Patent
Hou et al.

(10) Patent No.: US 11,168,870 B2
(45) Date of Patent: Nov. 9, 2021

(54) LIGHTING APPARATUS

(71) Applicant: XIAMEN LEEDARSON LIGHTING CO., LTD, Fujian (CN)

(72) Inventors: Shouqiang Hou, Fujian (CN); Yongzhe Dong, Fujian (CN); Xiaoliang Wen, Fujian (CN); Lixian Cai, Fujian (CN)

(73) Assignee: XIAMEN LEEDARSON LIGHTING CO., LTD, Xiamen (CN)

( * ) Notice: Subject to any disclaimer, the term of this patent is extended or adjusted under 35 U.S.C. 154(b) by 0 days.

(21) Appl. No.: 17/023,163

(22) Filed: Sep. 16, 2020

(65) Prior Publication Data

US 2021/0080083 A1 Mar. 18, 2021

(30) Foreign Application Priority Data

Sep. 16, 2019 (CN) ..... 201921535280.0
Sep. 16, 2019 (CN) ..... 201921535320.1
Sep. 16, 2019 (CN) ..... 201921535332.4

(51) Int. Cl.

| | |
|---|---|
| ***F21V 17/00*** | (2006.01) |
| ***F21V 23/06*** | (2006.01) |
| ***F21S 8/00*** | (2006.01) |
| ***F21S 2/00*** | (2016.01) |
| ***F21V 29/50*** | (2015.01) |
| ***F21V 5/00*** | (2018.01) |
| ***F21V 9/40*** | (2018.01) |
| ***F21V 23/00*** | (2015.01) |
| ***F21V 23/04*** | (2006.01) |
| ***F21V 7/04*** | (2006.01) |
| ***F21Y 115/10*** | (2016.01) |

(52) U.S. Cl.

CPC ..... *F21V 17/002* (2013.01); *F21S 2/005* (2013.01); *F21S 8/03* (2013.01); *F21V 5/004* (2013.01); *F21V 7/04* (2013.01); *F21V 9/40* (2018.02); *F21V 23/006* (2013.01); *F21V 23/0464* (2013.01); *F21V 23/06* (2013.01); *F21V 29/50* (2015.01); *F21Y 2115/10* (2016.08)

(58) Field of Classification Search

CPC ..... F21V 17/002; F21V 29/50; F21V 9/40; F21V 5/004; F21V 7/04; F21V 23/006; F21V 23/0464; F21V 23/06; F21S 2/005; F21S 8/03

USPC ..... 362/235

See application file for complete search history.

(56) References Cited

U.S. PATENT DOCUMENTS 5,909,955 A * 6/1999 Roorda ..... F21V 29/83 362/368
6,183,104 B1 * 2/2001 Ferrara ..... F21S 2/005 362/145

(Continued)

*Primary Examiner* — Bryon T Gyllstrom
(74) *Attorney, Agent, or Firm* — Chun-Ming Shih; Lanway IPR Services

(57) ABSTRACT

The lighting apparatus includes a top cover, a light passing cover, a lens, a light source plate, and a bottom cover. The top cover has a light opening. The light passing cover is fitting the light opening. A diffusion illumination or a light beam is selected by placing the light passing cover or the lens to the top cover respectively. The light source plate is mounted with a LED module. A base plate is used for mounting the light source plate and for connecting to the top cover forming a container space. The base plate has at least one receiver socket for connecting to an external device to electrically connect the LED module.

20 Claims, 13 Drawing Sheets

(56) References Cited

U.S. PATENT DOCUMENTS

| | | | | |
|---|---|---|---|---|
| 6,979,107 | B1 * | 12/2005 | Benensohn | F21S 8/02 362/133 |
| 9,400,100 | B2 * | 7/2016 | Wronski | F21V 29/503 |
| 10,094,540 | B2 * | 10/2018 | Scordino | F21V 19/00 |
| 2005/0237746 | A1 * | 10/2005 | Yiu | F21V 29/83 362/294 |
| 2012/0014108 | A1 * | 1/2012 | Greenfield | F21V 15/015 362/294 |
| 2012/0140442 | A1 * | 6/2012 | Woo | F21V 7/04 362/95 |
| 2012/0262928 | A1 * | 10/2012 | Matsuda | F21S 8/026 362/373 |
| 2012/0293997 | A1 * | 11/2012 | Zaderej | F21V 29/70 362/235 |
| 2014/0063818 | A1 * | 3/2014 | Randolph | F21S 8/02 362/311.02 |
| 2014/0268768 | A1 * | 9/2014 | Holland | F21K 9/20 362/249.02 |
| 2015/0009676 | A1 * | 1/2015 | Danesh | H04R 23/02 362/296.01 |
| 2019/0301718 | A1 * | 10/2019 | Desai | F21V 19/04 |

* cited by examiner

LIGHTING APPARATUS

FIELD

The present invention is related to a lighting apparatus, and more particularly related to a lighting apparatus to be used in a closet.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Some lighting devices are disposed in a closet to provide illumination.

It is difficult to install or deploy such devices. It is also inconvenient to change settings of such devices.

Therefore, it is beneficial to provide a flexible design of lighting apparatuses to be placed in a closet. Some lighting devices are disposed in a closet to provide illumination.

It is difficult to install or deploy such devices. It is also inconvenient to change settings of such devices.

Therefore, it is beneficial to provide a flexible design of lighting apparatuses to be placed in a closet. Some lighting devices are disposed in a closet to provide illumination.

It is difficult to install or deploy such devices. It is also inconvenient to change settings of such devices.

Therefore, it is beneficial to provide a flexible design of lighting apparatuses to be placed in a closet. Some lighting devices are disposed in a closet to provide illumination.

It is difficult to install or deploy such devices. It is also inconvenient to change settings of such devices.

Therefore, it is beneficial to provide a flexible design of lighting apparatuses to be placed in a closet.

SUMMARY

In some embodiments, a lighting apparatus includes a top cover, a light passing cover, a lens, a light source plate, and a bottom cover. The top cover has a light opening. The light passing cover is fitting the light opening. The lens is fitting the light opening.

The light passing cover and the light lens is selectively attached to the top cover. A diffusion illumination or a light beam is selected by placing the light passing cover or the lens to the top cover respectively.

The light source plate is mounted with a LED module. A base plate is used for mounting the light source plate and for connecting to the top cover forming a container space.

The base plate has at least one receiver socket for connecting to an external device to electrically connect the LED module. The base plate has a base connector.

The bottom cover is fixed to a plane, e.g. a surface of an inner plate of a closet.

The bottom cover has a bottom connector for detachably connecting to the base connector.

When users want to use diffusion illumination, the top cover is removed and the light passing cover is inserted.

When users want to use light beam mode for a focused object, the light passing cover is replaced with the lens.

The bottom cover is fixed to the closet first. When necessary, the module of the top cover and the base plate is attached to the bottom cover.

The receiver socket is used for receiving power used by the LED module of the light source plate.

In some embodiments, the bottom cover has a screw hole for fixing to a closet, the base plate connected with the top cover is attached to the bottom cover when necessary.

The LED module receives a power supply from a connecting wire inserted into the receiver socket.

Users may attach screws or nails or plugging structures or sticking tape to fix the bottom cover to the closet first.

A power wire may be inserted into the receiver socket to send electricity to the LED module. In some embodiments, there is a driver circuit converting the external power source, e.g. 110V alternating current to a driving current used by the LED module.

In some embodiments, the receiver module has a wire stop for pressing and fixing a wire inserted into the receiver socket.

The wire stop has a pressing structure for fixing a metal electrode of a connector wire to route electricity from the connector wire to components of the lighting apparatus.

In some embodiments, the base plate has a bridge socket for connecting in series to another lighting apparatus of the same type.

In addition to the receiver socket, there may be more than one sockets. Some sockets may be used for connecting a neighbor device with the same type or a different type and are called bridge sockets. Such socket may have the same structure as the receiver socket or have different structure as the receiver socket.

In some embodiments, the base plate has a driver circuit converting an external power received from the receiver socket to a driving current supplied to the LED module.

In some embodiments, said another lighting apparatus has another LED module receiving another driving current generated by the driver circuit.

The neighbor device, i.e. said another lighting apparatus, may share the driver circuit of this lighting apparatus.

In some embodiments, the receiver socket is connected to a first neighbor device and the bridge socket is connected to a second neighbor device.

The lighting apparatus, the first neighbor device and the second neighbor device have different identification codes.

A controller sends a control signal associated with a receiver identification passing through the first neighbor device, the lighting apparatus and the second neighbor device.

When multiple lighting apparatuses are connected in series, a controller may send a control signal to control the lighting apparatuses respectively.

Different lighting apparatuses are assigned with different identification codes and the control signal is sent passing the multiple lighting apparatuses, but only the lighting apparatus with the corresponding identification code receives and executes the control signal, e.g. to change light intensity or color.

In some embodiments, the base plate has a light detector for detecting an environment light level for determining a control of the LED module.

Such light detector may be used to automate turn on or turn off, or dynamically adjust light intensity based on ambient light intensity.

In some embodiments, the base plate and the bottom cover have a gap space for air flowing in the gap space for heat dissipation.

The base plate is not completely engaging the bottom cover, to prevent electricity shock and also provides a space for heat dissipation.

In some embodiments, the lighting apparatus may also include a manual switch for selecting an object type.

The LED module is controlled to emit a light optimized to the object type.

The manual switch may be adjusted to change color temperature, color rendering parameters or other parameters.

For example, for optimization visual effect of different types of objects, corresponding color temperatures, light intensities and other parameters may be determined and used for generating different lights optimized for different object types.

Such parameters may be stored in table and the manual switch is operated by a user to select one set of parameters to generate a corresponding output light.

In some embodiments, a socket cover is attached to the receiver cover when no connector wire is inserted into the receiver socket to prevent dust entering the base plate.

The socket cover is used for concealing the opening of the receiver cover to prevent dust or other things entering the base plate, damaging the components of the lighting apparatus.

In some embodiments, the lens has a bottom part sitting on the light source plate.

In some embodiments, the bottom part of the lens has a reflector cup with a narrow bottom surrounding a LED module of the light source plate.

A radial diameter of the bottom part is increased from the narrow bottom to a top plate of the lens.

In some embodiments, an inner wall of the reflector cup has reflector protruding blocks.

In some embodiments, an exterior surface of the reflector cup has a reflector layer.

In some embodiments, the lens has a top plate, a bottom surface of the top plate is connected to the bottom part.

An inner surface of the top plate has multiple diffusion protruding blocks facing toward the light source plate.

In some embodiments, the top plate has a top surface opposite to the bottom surface.

The top surface of the top plate has a peripheral flat ring surrounding a central lens portion.

In some embodiments, the central lens has a convex lens and a concave ring lower surrounding the convex lens.

In some embodiments, the central lens has multiple micro-lens.

In some embodiments, the light passing cover has a color filter for changing an output color.

DETAILED DESCRIPTION

Figure 15:
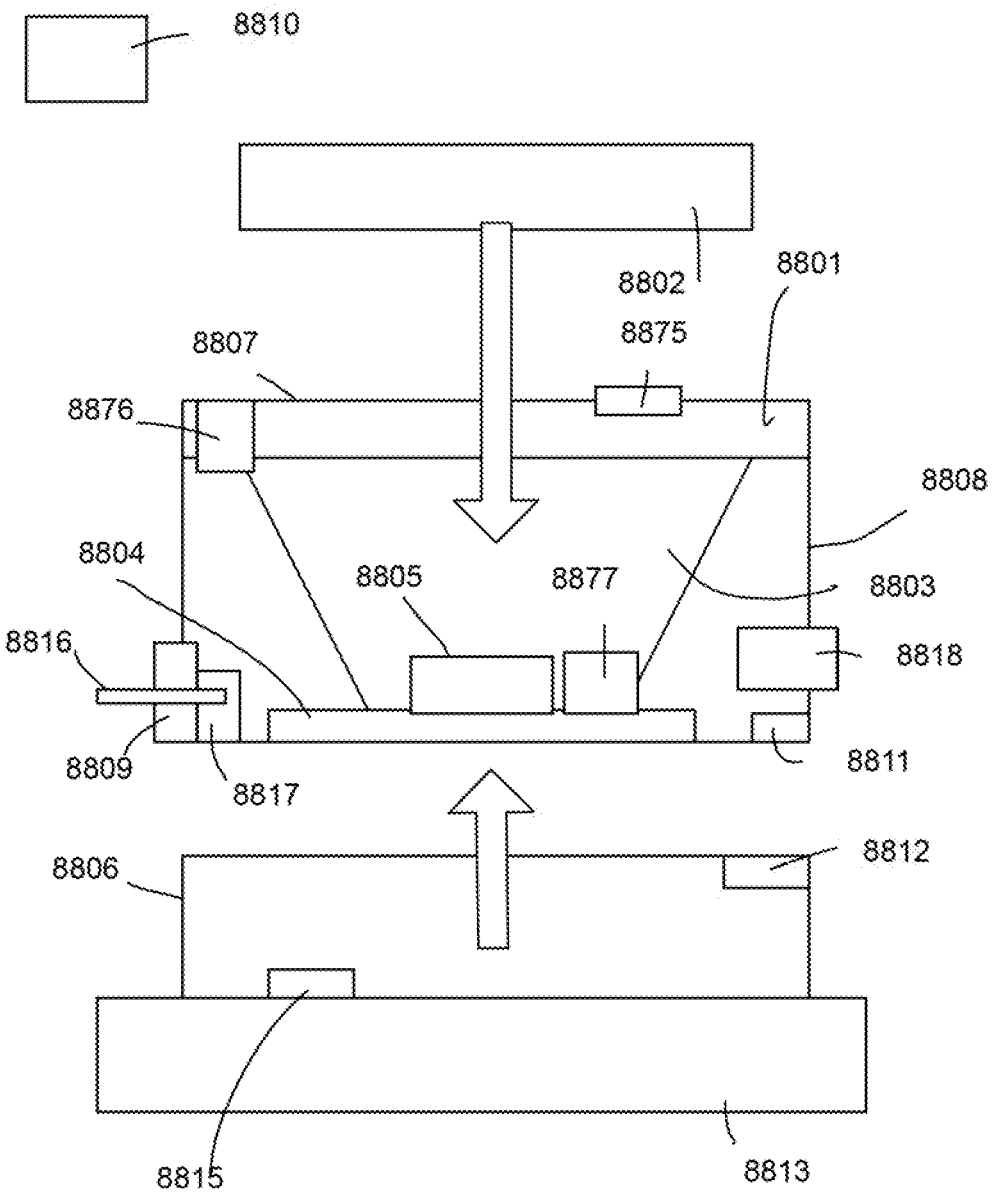
FIG. 15 illustrates a lighting apparatus embodiment.

In FIG. 15, a lighting apparatus includes a top cover 8801, a light passing cover 8802, a lens 8803, a light source plate 8804, and a bottom cover 8806. The top cover 8801 has a light opening 8807. The light passing cover 8802 is fitting the light opening 8807. The lens 8803 is fitting the light opening 8807. Specifically, the diameter of the lens 8803 and the light passing cover 8807 is proper to be installed or attached to the top cover.

The light passing cover 8802 and the lens 8803 is selectively attached to the top cover 8801. A diffusion illumination or a light beam is selected by placing the light passing cover 8802 or the lens 8803 to the top cover respectively.

The light source plate 8804 is mounted with a LED module 8805. The base plate 8808 is used for mounting the light source plate 8804 and for connecting to the top cover 8801 forming a container space.

The base plate 8808 has at least one receiver socket 8809 for connecting to an external device 8810 to electrically connect the LED module 8805. The base plate 8808 has a base connector 8811.

The bottom cover 8806 is fixed to a plane 8813, e.g. a surface of an inner plate of a closet.

The bottom cover 8813 has a bottom connector 8812 for detachably connecting to the base connector 8811.

When users want to use diffusion illumination, the top cover is removed and the light passing cover is inserted.

When users want to use light beam mode for a focused object, the light passing cover is replaced with the lens.

The bottom cover is fixed to the closet first. When necessary, the module of the top cover and the base plate is attached to the bottom cover.

The receiver socket is used for receiving power used by the LED module of the light source plate.

In some embodiments, the bottom cover has a screw hole 8815 for fixing to a closet, the base plate 8808 connected with the top cover 8801 is attached to the bottom cover 8806 when necessary.

The LED module 8805 receives a power supply from a connecting wire 8816 inserted into the receiver socket 8809.

Users may attach screws or nails or plugging structures or sticking tape to fix the bottom cover to the closet first.

A power wire may be inserted into the receiver socket to send electricity to the LED module. In some embodiments, there is a driver circuit converting the external power source, e.g. 110V alternating current to a driving current used by the LED module.

In some embodiments, the receiver module has a wire stop 8817 for pressing and fixing a wire inserted into the receiver socket 8809.

The wire stop 8817 has a pressing structure for fixing a metal electrode of a connector wire to route electricity from the connector wire to components of the lighting apparatus.

In some embodiments, the base plate has a bridge socket 8818 for connecting in series to another lighting apparatus of the same type.

In addition to the receiver socket, there may be more than one sockets. Some sockets may be used for connecting a neighbor device with the same type or a different type and are called bridge sockets. Such socket may have the same structure as the receiver socket or have different structure as the receiver socket.

In FIG. 15, the base plate has a driver circuit 8877 converting an external power received from the receiver socket to a driving current supplied to the LED module.

In some embodiments, said another lighting apparatus has another LED module receiving another driving current generated by the driver circuit.

The neighbor device, i.e. said another lighting apparatus, may share the driver circuit of this lighting apparatus.

Figure 16:
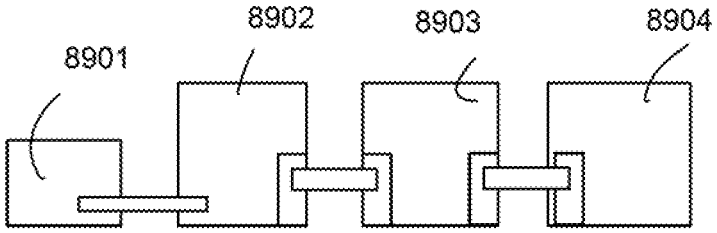
FIG. 16 shows multiple devices connected in series.

In FIG. 16, the receiver socket is connected to a first neighbor device 8902 and the bridge socket is connected to a second neighbor device 8904.

The lighting apparatus 8903, the first neighbor device 8902 and the second neighbor device 8903 have different identification codes.

A controller 8901 sends a control signal associated with a receiver identification passing through the first neighbor device, the lighting apparatus and the second neighbor device.

When multiple lighting apparatuses are connected in series, a controller may send a control signal to control the lighting apparatuses respectively.

Different lighting apparatuses are assigned with different identification codes and the control signal is sent passing the multiple lighting apparatuses, but only the lighting apparatus with the corresponding identification code receives and executes the control signal, e.g. to change light intensity or color.

In FIG. 15, the base plate has a light detector 8876 for detecting an environment light level for determining a control of the LED module.

Such light detector may be used to automate turn on or turn off, or dynamically adjust light intensity based on ambient light intensity.

Figure 2:
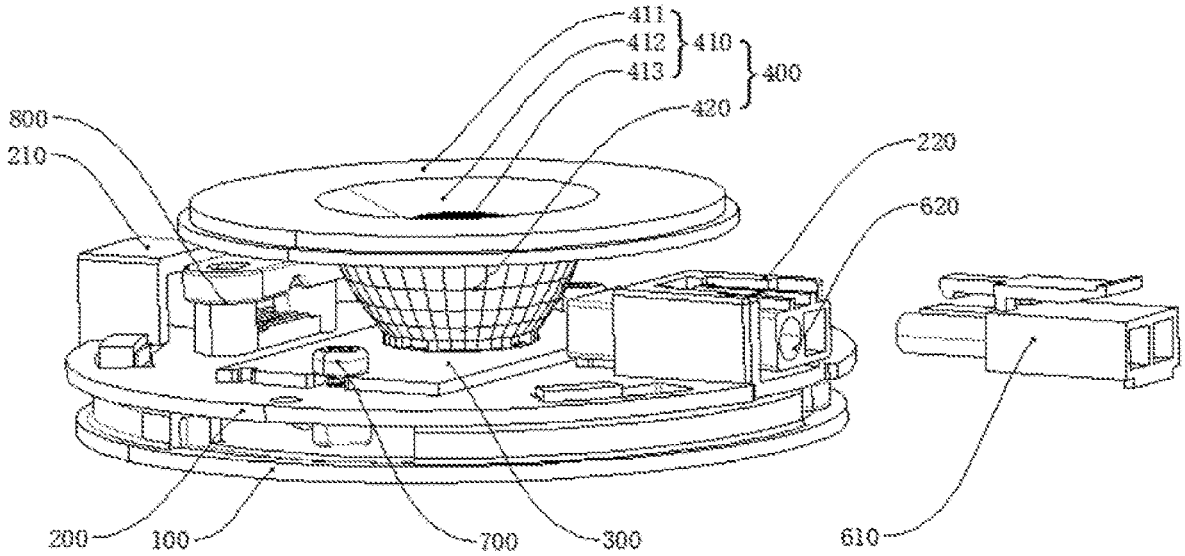
FIG. 2 illustrates a view illustrating components in an embodiment.

In some embodiments, the base plate and the bottom cover have a gap space, e.g. the space illustrated in FIG. 2, for air flowing in the gap space for heat dissipation.

The base plate is not completely engaging the bottom cover, to prevent electricity shock and also provides a space for heat dissipation.

In FIG. 15, the lighting apparatus may also include a manual switch 8875 for selecting an object type.

The LED module is controlled to emit a light optimized to the object type.

The manual switch may be adjusted to change color temperature, color rendering parameters or other parameters.

For example, for optimization visual effect of different types of objects, corresponding color temperatures, light intensities and other parameters may be determined and used for generating different lights optimized for different object types.

Such parameters may be stored in table and the manual switch is operated by a user to select one set of parameters to generate a corresponding output light.

In some embodiments, a socket cover is attached to the receiver cover when no connector wire is inserted into the receiver socket to prevent dust entering the base plate.

The socket cover is used for concealing the opening of the receiver cover to prevent dust or other things entering the base plate, damaging the components of the lighting apparatus.

Figure 10:
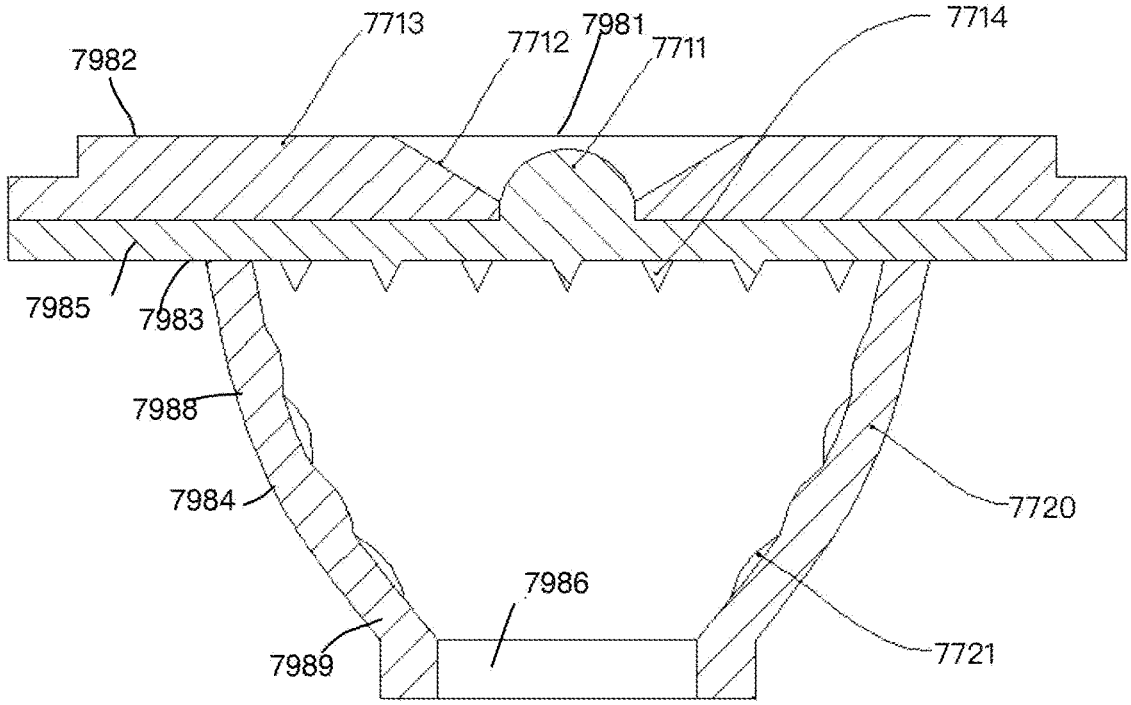
FIG. 10 illustrates a side view of the lens example in FIG. 9.

In FIG. 10, the lens has a bottom part 7988 sitting on the light source plate.

In some embodiments, the bottom part 7988 of the lens has a reflector cup 7720 with a narrow bottom 7989 surrounding a LED module 7986 of the light source plate.

A radial diameter of the bottom part is increased from the narrow bottom to a top plate 7985 of the lens.

In some embodiments, an inner wall of the reflector cup 7720 has reflector protruding blocks 7721 for diffusing the light.

In some embodiments, an exterior surface of the reflector cup 7720 has a reflector layer 7984.

In some embodiments, the lens has a top plate 7985. A bottom surface 7983 of the top plate 7985 is connected to the bottom part 7988.

An inner surface of the top plate has multiple diffusion protruding blocks 7714 facing toward the light source plate.

In some embodiments, the top plate 7985 has a top surface 7 opposite to the bottom surface.

The top surface 7982 of the top plate 7985 has a peripheral flat ring 7713 surrounding a central lens portion 7981.

In some embodiments, the central lens portion 7981 has a convex lens 7711 and a concave ring 7712 surrounding the convex lens 7711.

Figure 9:
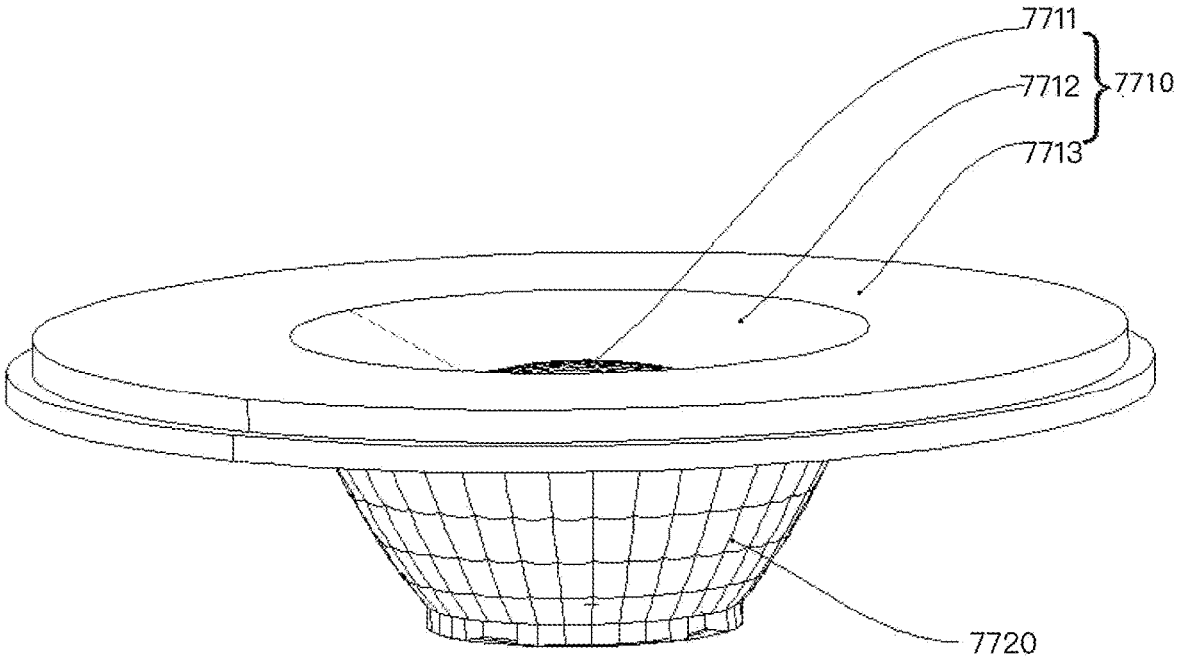
FIG. 9 illustrates a lens example.

In some embodiments, the central lens has multiple micro-lens, e.g. the central lens illustrated in FIG. 9.

FIG. 9 shows another view of the example of FIG. 10. The same reference numerals refer to the same components and are not repeated for brevity.

Figure 1:
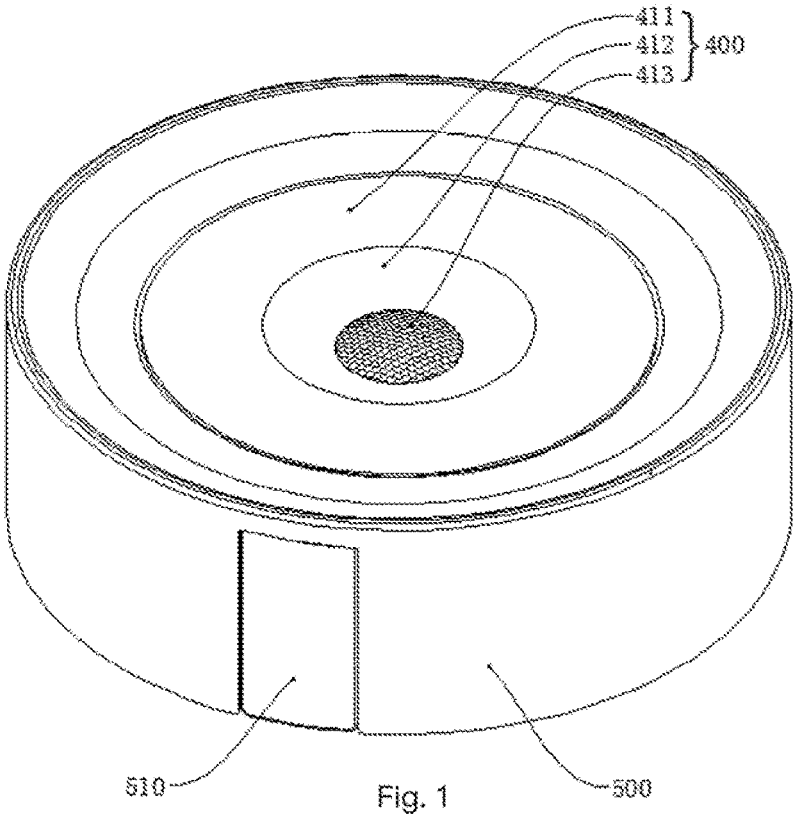
FIG. 1 illustrates a lighting apparatus embodiment.

Please refer to FIG. 1. In FIG. 1, the lighting apparatus includes a lens 400 with multiple portions 411, 412, 413. There is a concealing cover 510 for concealing a receiver socket when no wire is inserted into the receiver socket. There is a top cover 500.

In FIG. 2, in addition to the components mentioned in FIG. 1, there is a bridge socket 220, a receiver socket 210. A wire stop 800 is used for fixing an inserted wire. The bridge socket 220 has a connector 620 connecting to a corresponding connector 610.

A light source plate 300 is placed on a base plate 200. The base plate 200 is fixed to a bottom cover 100 with a screw 700. The lens 400 has a reflector cup 420.

Figure 3:
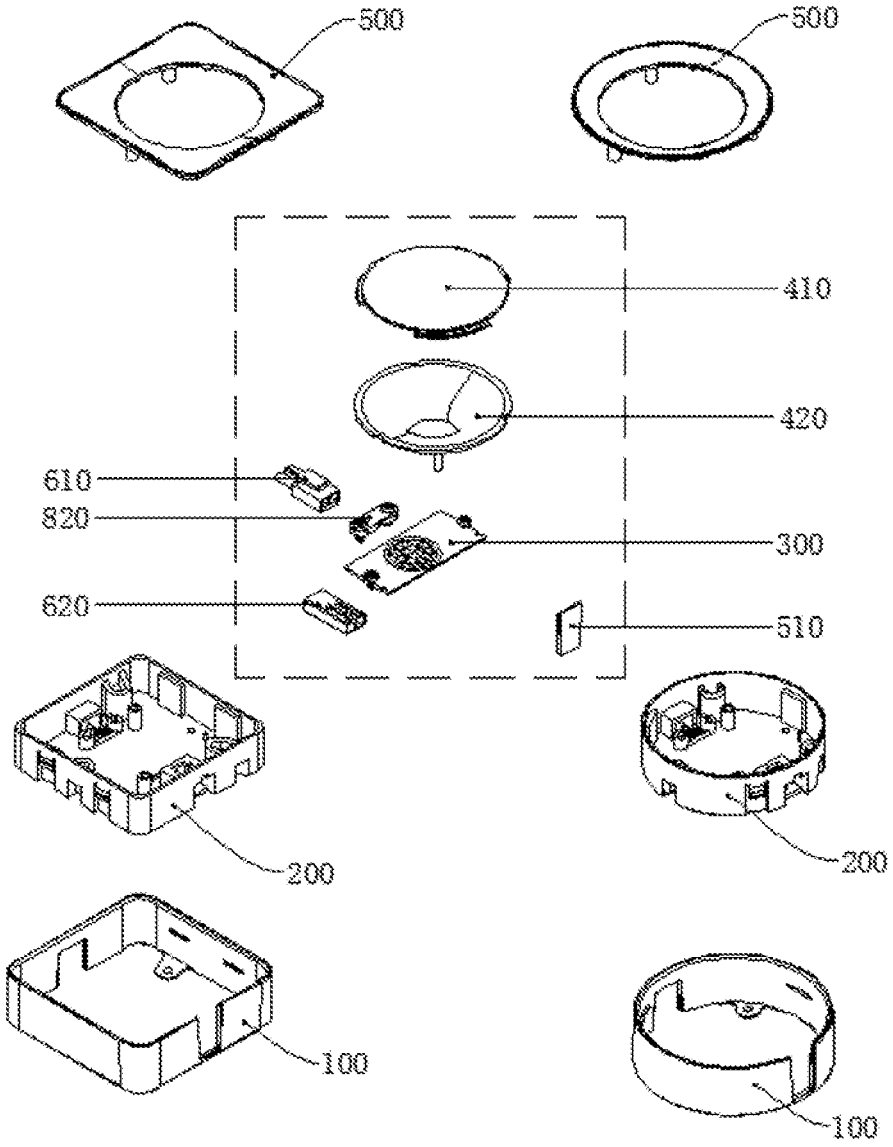
FIG. 3 illustrates two embodiments of different geometric shapes.

FIG. 3 shows two geometric shape examples. A rectangular example is illustrated in the left side and a circular shape example is illustrated in the right side.

The top cover 500 may be connected to either a light passing cover 410 or a lens 420. The receiver socket 610 is working with a wire stop 820 for connecting a wire. The light source plate 300 is used for mounting a LED module. The concealing cover 510 is used for protecting the components in the base plate 200, that is further attached to the bottom cover 100.

Figure 4:
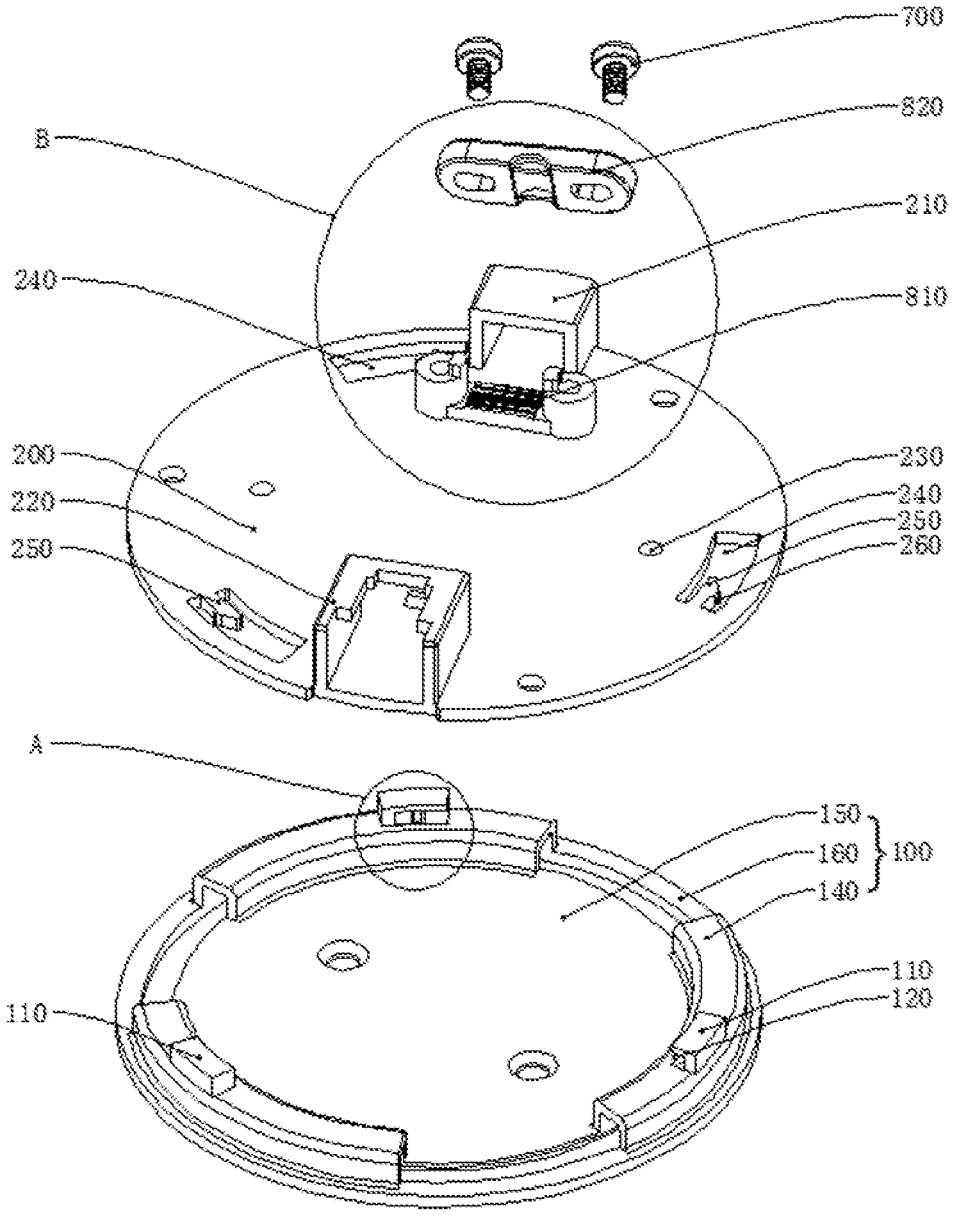
FIG. 4 illustrates an exploded view of an embodiment.

In FIG. 4, the screw 700 is used in the wire stop 820. There is a wire platform 810. Sliding grooves 240 are used for connecting to protruding structures 110 of the bottom cover 100. A limiter structure 110 and 120 are used for limiting and aligning the connection.

Figure 5:
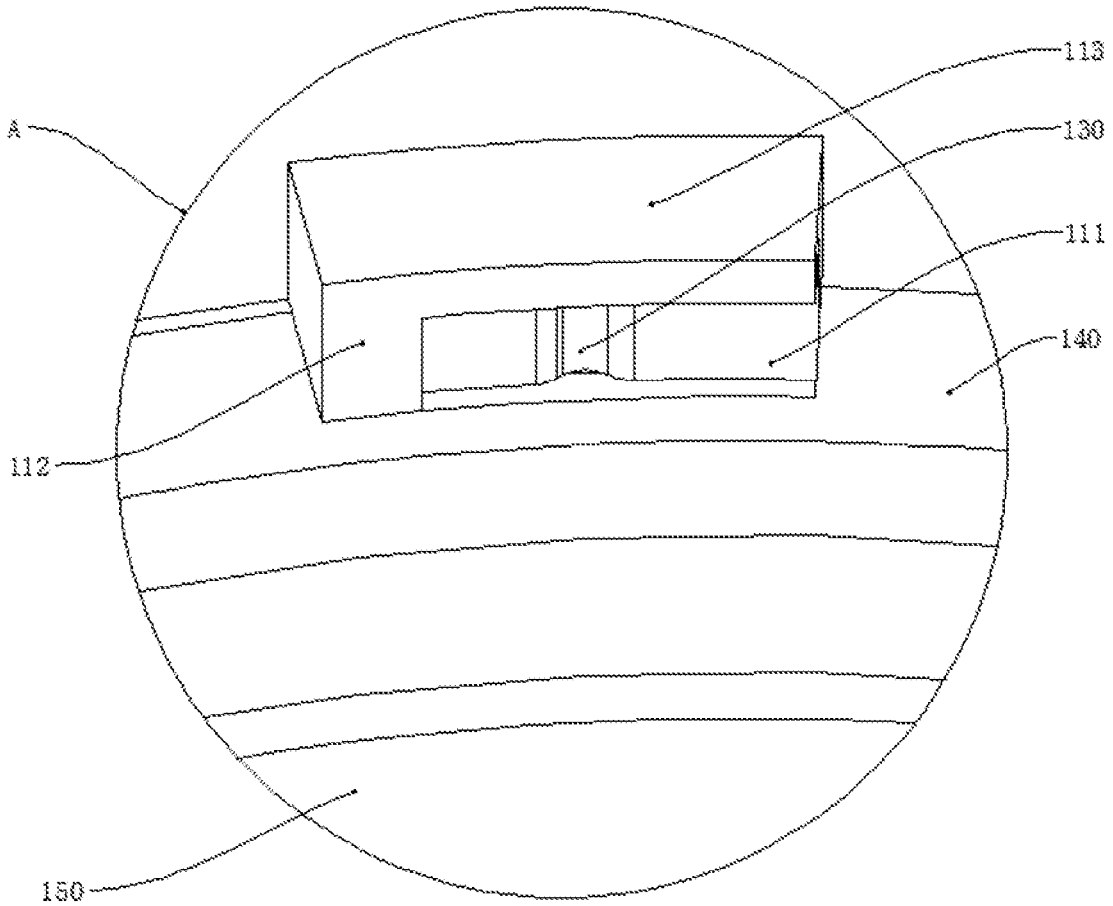
FIG. 5 illustrates a zoom-up of a component in an embodiment.
Figure 6:
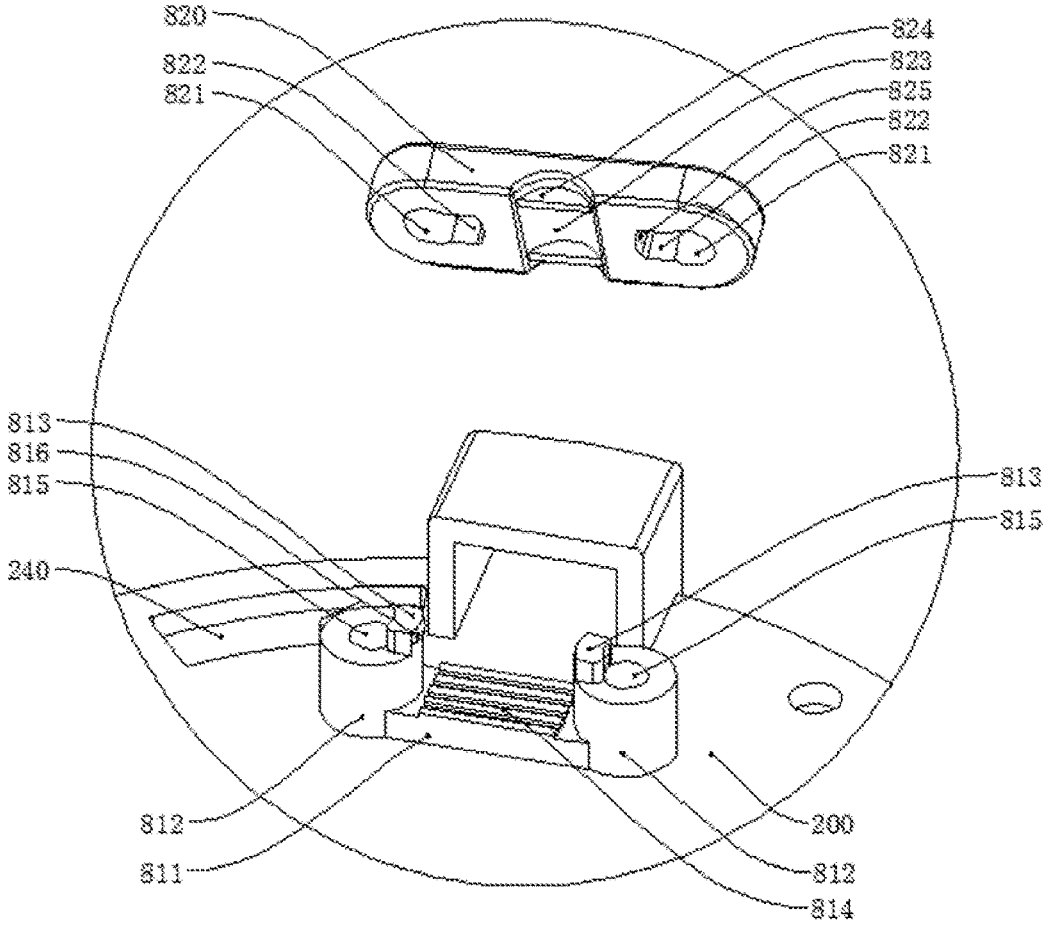
FIG. 6 illustrates a receiver socket example.
Figure 7:
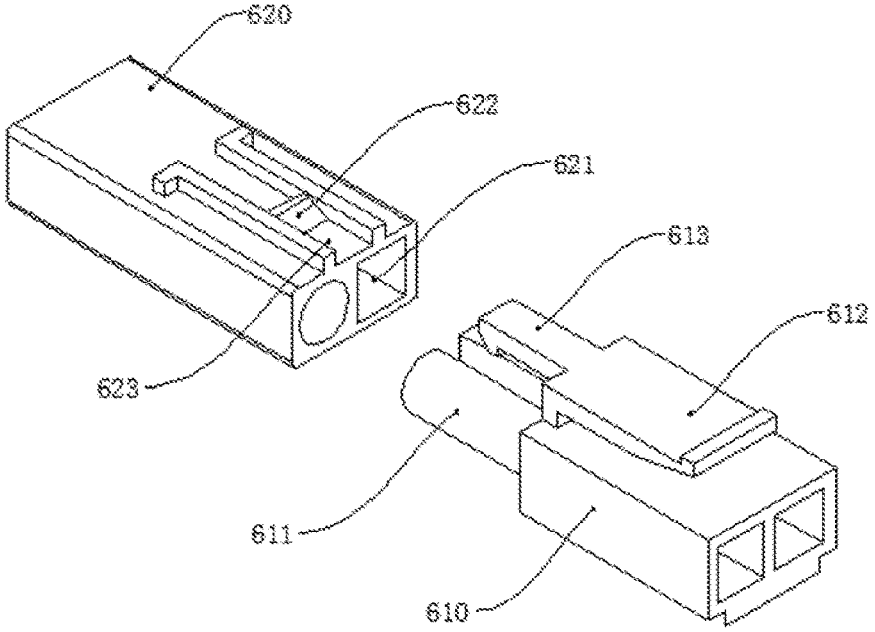
FIG. 7 illustrates a connector example.
Figure 8:
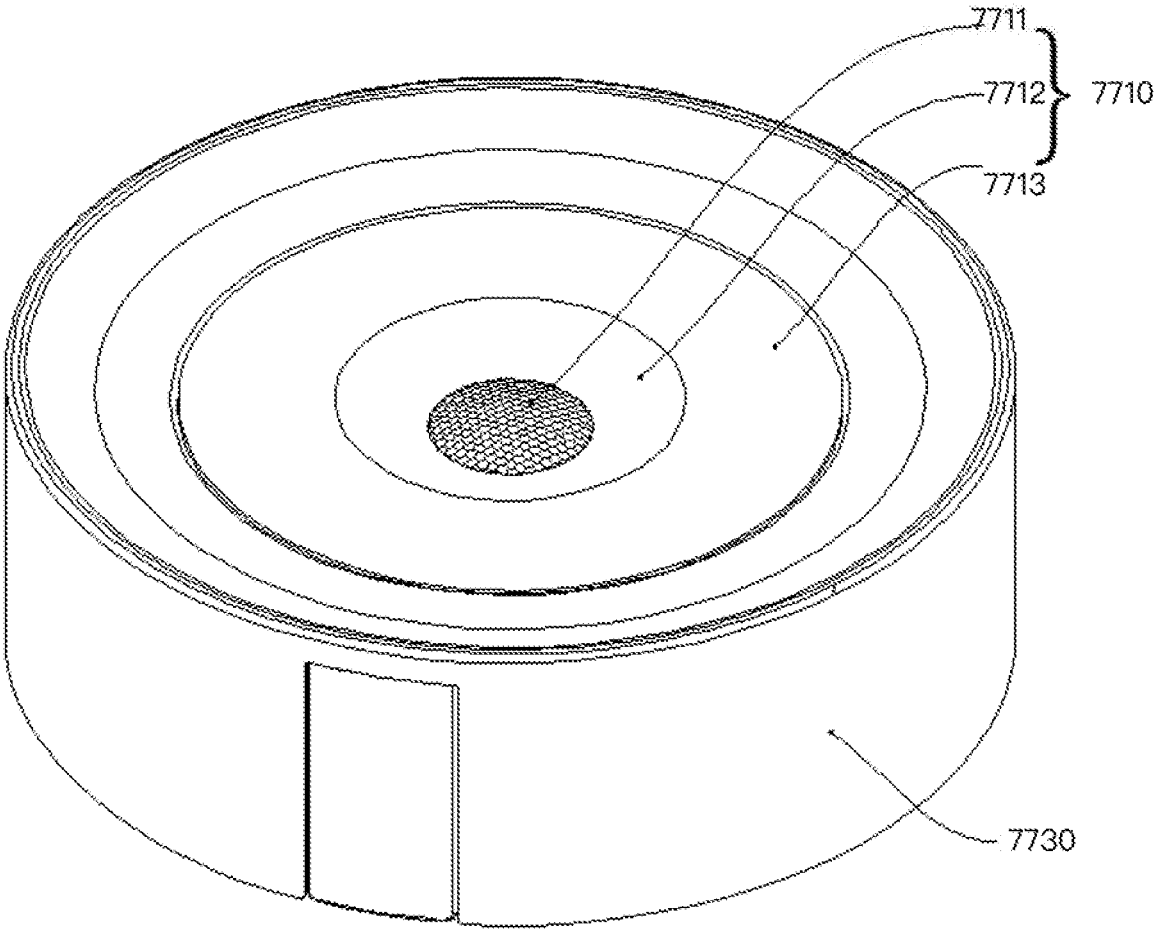
FIG. 8 illustrates a first mode of a lighting apparatus.

FIG. 5, FIG. 6 and FIG. 7 show a zoom-up views of the example in FIG. 4.

Figure 11:
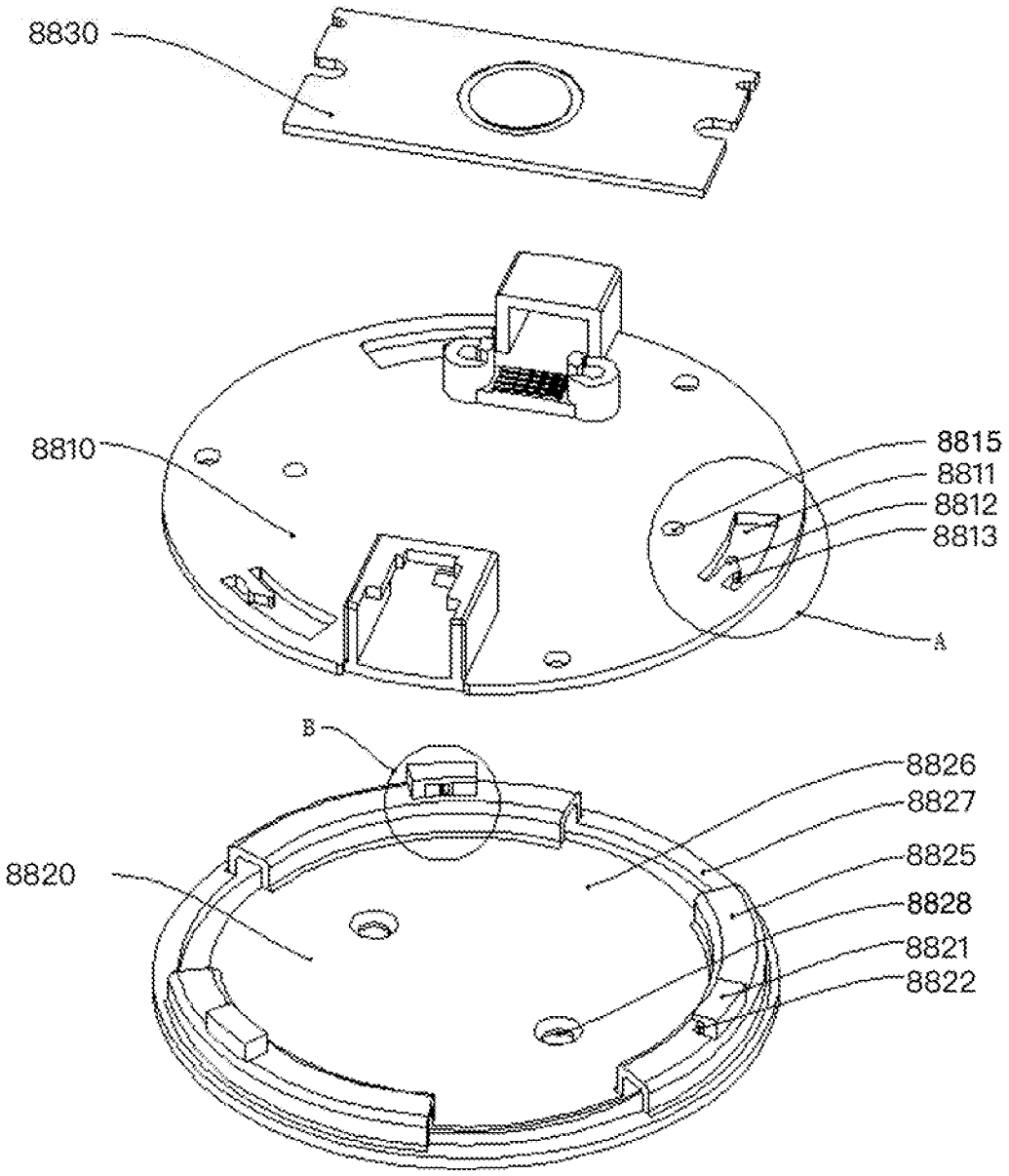
FIG. 11 illustrates another exploded view of components in an embodiment.
Figure 12:
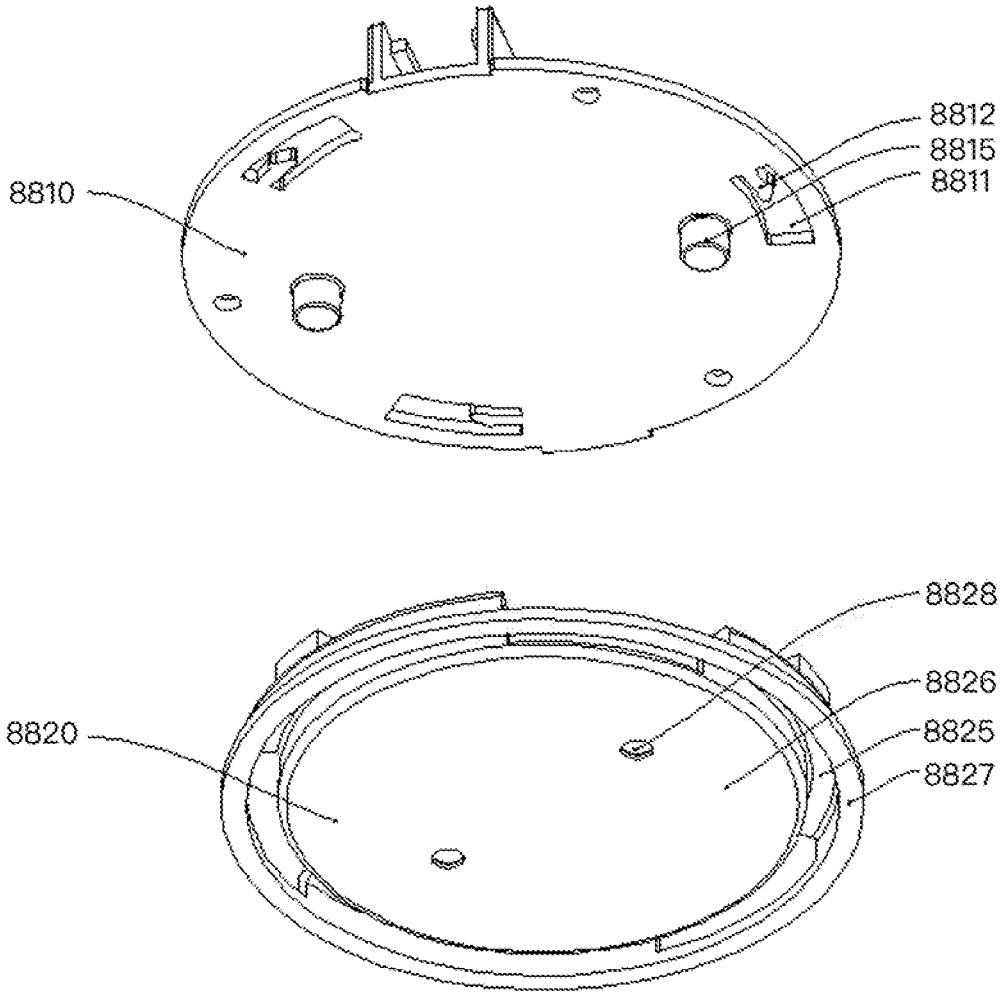
FIG. 12 illustrates another view of the example in FIG. 11.

FIG. 11 and FIG. 12 show exploded views of components.

Figure 13:
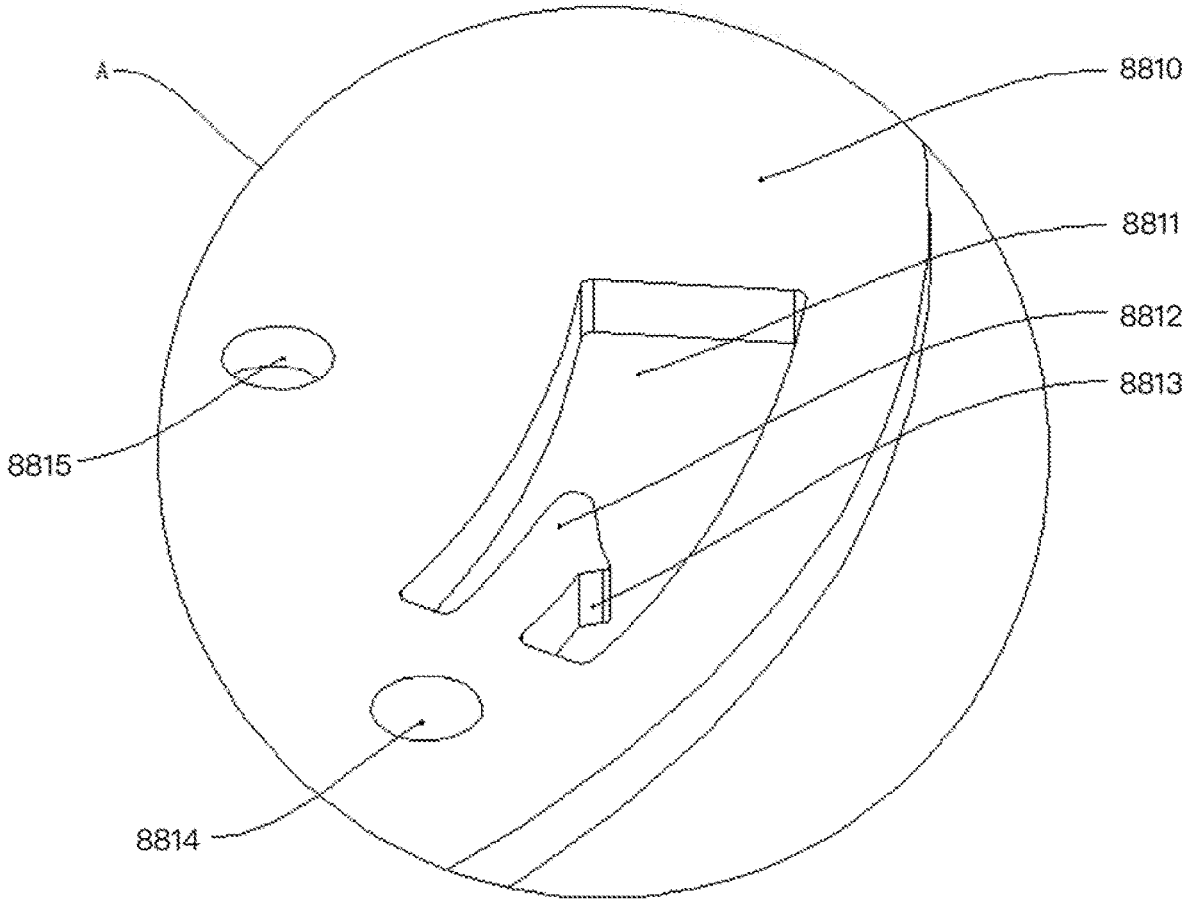
FIG. 13 illustrates a zoom-up view of a connector structure in an embodiment.
Figure 14:
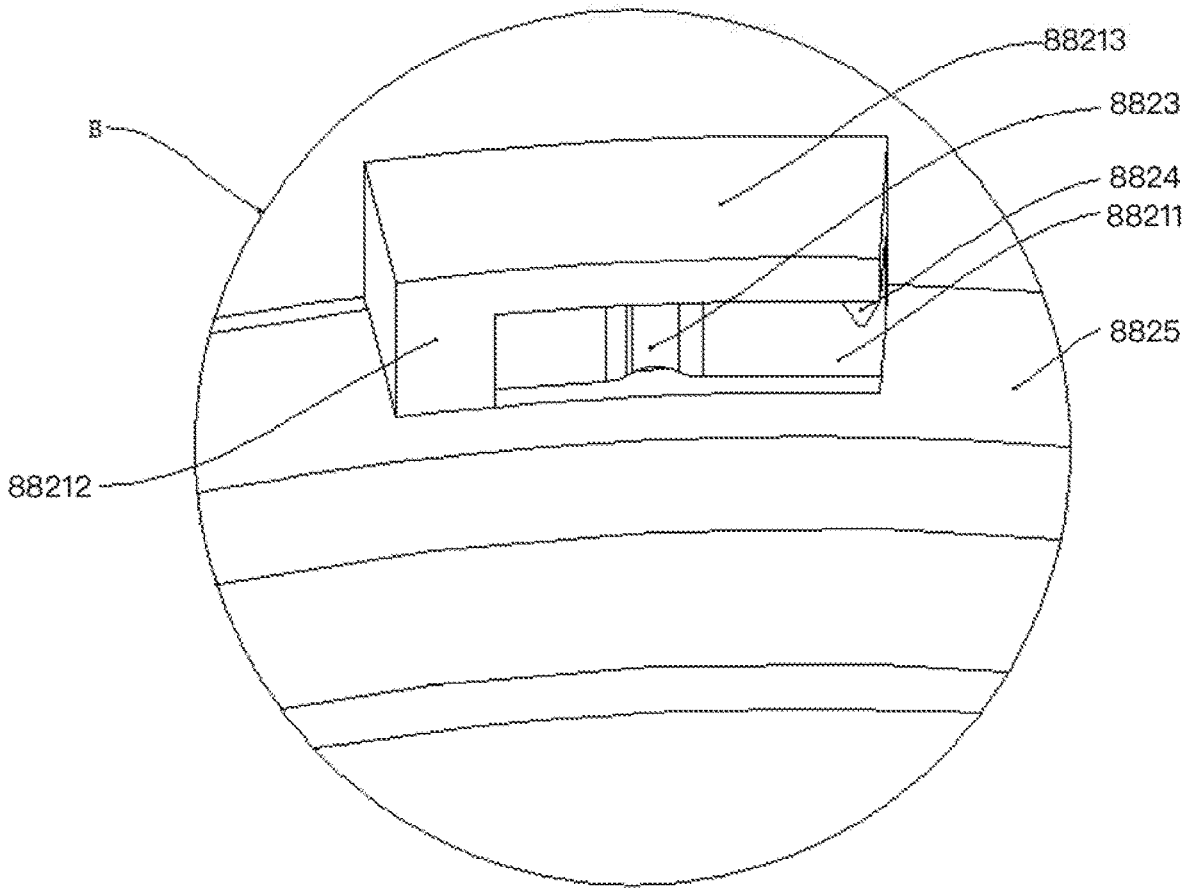
FIG. 14 illustrates another zoom-up view of a connector structure in an embodiment.

FIG. 13 and FIG. 14 show a zoom-up views of a portion of components.

In some embodiments, the light passing cover has a color filter for changing an output color.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a top cover having a light opening;

a light passing cover fitting the light opening;

a lens fitting the light opening, wherein the light passing cover and the light lens is selectively attached to the top cover to select a diffusion illumination or a a light beam respectively;

a light source plate mounted with a LED module;

a base plate for mounting the light source plate and for connecting to the top cover forming a container space, wherein the base plate has at least one receiver socket for connecting to an external device to electrically connect the LED module, the base plate has a base connector; and a bottom cover for fixing to a plane, wherein the bottom cover has a bottom connector for detachably connecting to the base connector.

2. The lighting apparatus of claim 1, wherein the bottom cover has a screw hole for fixing to a closet, the base plate connected with the top cover is attached to the bottom cover when necessary, the LED module receives a power supply from a connecting wire inserted into the receiver socket.

3. The lighting apparatus of claim 1, wherein the receiver module has a wire stop for pressing and fixing a wire inserted into the receiver socket.

4. The lighting apparatus of claim 1, wherein the base plate has a bridge socket for connecting in series to another lighting apparatus of the same type.

5. The lighting apparatus of claim 4, wherein the base plate has a driver circuit converting an external power received from the receiver socket to a driving current supplied to the LED module.

6. The lighting apparatus of claim 5, wherein said another lighting apparatus has another LED module receiving another driving current generated by the driver circuit.

7. The lighting apparatus of claim 4, wherein the receiver socket is connected to a first neighbor device and the bridge socket is connected to a second neighbor device, the lighting apparatus, the first neighbor device and the second neighbor device have different identification codes, a controller sends a control signal associated with a receiver identification passing through the first neighbor device, the lighting apparatus and the second neighbor device.

8. The lighting apparatus of claim 1, wherein the base plate has a light detector for detecting an environment light level for determining a control of the LED module.

9. The lighting apparatus of claim 1, wherein the base plate and the bottom cover have a gap space for air flowing in the gap space for heat dissipation.

10. The lighting apparatus of claim 1, further comprising a manual switch for selecting an object type, wherein the LED module is controlled to emit a light optimized to the object type.

11. The lighting apparatus of claim 1, wherein a socket cover is attached to the receiver cover when no connector wire is inserted into the receiver socket to prevent dust entering the base plate.

12. The lighting apparatus of claim 1, wherein the lens has a bottom part sitting on the light source plate.

13. The lighting apparatus of claim 12, wherein the bottom part of the lens has a reflector cup with a narrow bottom surrounding a LED module of the light source plate, a radial diameter of the bottom part is increased from the narrow bottom to a top plate of the lens.

14. The lighting apparatus of claim 13, wherein an inner wall of the reflector cup has reflector protruding blocks.

15. The lighting apparatus of claim 13, wherein an exterior surface of the reflector cup has a reflector layer.

16. The lighting apparatus of claim 12, wherein the lens has a top plate, a bottom surface of the top plate is connected to the bottom part, an inner surface of the top plate has multiple diffusion protruding blocks facing toward the light source plate.

17. The lighting apparatus of claim 16, wherein the top plate has a top surface opposite to the bottom surface, the top surface of the top plate has a peripheral flat ring surrounding a central lens portion.

18. The lighting apparatus of claim 17, wherein the central lens has a convex lens and a concave ring lower surrounding the convex lens.

19. The lighting apparatus of claim 17, wherein the central lens has multiple micro-lens.

20. The lighting apparatus of claim 1, wherein the light passing cover has a color filter for changing an output color.

* * * * *